US007506504B2

(12) United States Patent
Kumar

(10) Patent No.: US 7,506,504 B2
(45) Date of Patent: Mar. 24, 2009

(54) DOC AND PARTICULATE CONTROL SYSTEM FOR DIESEL ENGINES

(75) Inventor: Sanath V. Kumar, North Brunswick, NJ (US)

(73) Assignee: BASF Catalysts LLC, Florham Park, NJ (US)

( * ) Notice: Subject to any disclaimer, the term of this patent is extended or adjusted under 35 U.S.C. 154(b) by 10 days.

(21) Appl. No.: 11/314,922

(22) Filed: Dec. 21, 2005

(65) Prior Publication Data

US 2007/0137187 A1 Jun. 21, 2007

(51) Int. Cl.
*F01N 3/10* (2006.01)

(52) U.S. Cl. ..... 60/299; 60/274; 60/295; 60/297; 60/301; 422/170; 422/171; 422/177

(58) Field of Classification Search ..... 60/274, 60/295, 297, 299, 301, 311; 422/170, 171, 422/177, 178

See application file for complete search history.

(56) References Cited

U.S. PATENT DOCUMENTS 3,111,396 A 11/1963 Ball
3,904,551 A 9/1975 Lundsager et al.
3,993,572 A 11/1976 Hindin et al.
4,027,367 A 6/1977 Rondeau
4,157,316 A 6/1979 Thompson et al.
4,171,288 A 10/1979 Keith et al.
4,294,726 A 10/1981 Bozon et al.
4,329,162 A 5/1982 Pitcher, Jr.
4,340,403 A 7/1982 Higuchi et al.
4,354,760 A 10/1982 Schiffner
4,403,008 A 9/1983 Factor
4,476,246 A 10/1984 Kim et al.
4,510,265 A 4/1985 Hartwig
4,519,820 A 5/1985 Oyobe et al.
4,535,588 A * 8/1985 Sato et al. ..... 60/286
4,559,193 A 12/1985 Ogawa et al.
4,563,414 A 1/1986 Ogawa et al.
4,591,578 A 5/1986 Foley et al.
4,591,580 A 5/1986 Kim et al.
4,597,262 A 7/1986 Retallick
4,624,940 A 11/1986 Wan et al.
4,708,946 A 11/1987 Ohata et al.

(Continued)

FOREIGN PATENT DOCUMENTS

EP 835 684 A2 4/1998

(Continued)

OTHER PUBLICATIONS

Arun D. Jatkar, "A New Catalyst Support For Automotive Catalytic Converters", SAE Technical Paper 971032, Congress and Exposition, Detroit, Michigan, Feb. 24-27, 1997.

*Primary Examiner*—Binh Q. Tran
(74) *Attorney, Agent, or Firm*—Phillip R. Kiefer; Frenkel & Associates, P.C.; Melanie L. Brown

(57) ABSTRACT

The present invention is directed to an emission treatment system for the treatment and/or conversion of engine emissions and particulate matter from diesel engines. The emission treatment system of the present invention comprises an upstream oxidation catalyst, a particulate filter or soot filter section and optionally a downstream catalytic element or clean-up catalyst for the treatment and/or conversion of any remaining emission gas stream contaminants.

12 Claims, 2 Drawing Sheets

U.S. PATENT DOCUMENTS

| | | | | |
|---|---|---|---|---|
| 4,714,694 | A | 12/1987 | Wan et al. | |
| 4,727,052 | A | 2/1988 | Wan et al. | |
| 4,902,487 | A | 2/1990 | Cooper et al. | |
| 4,965,243 | A | 10/1990 | Yamada et al. | |
| 5,057,483 | A | 10/1991 | Wan | |
| 5,100,632 | A | 3/1992 | Dettling et al. | |
| 5,145,825 | A | 9/1992 | Deeba et al. | |
| 5,409,669 | A * | 4/1995 | Smith et al. | 422/174 |
| 5,462,907 | A | 10/1995 | Farrauto et al. | |
| 5,491,120 | A | 2/1996 | Voss et al. | |
| 5,560,757 | A | 10/1996 | Suzuki et al. | |
| 5,597,771 | A | 1/1997 | Hu et al. | |
| 5,627,124 | A | 5/1997 | Farrauto et al. | |
| 6,274,107 | B1 | 8/2001 | Yavuz et al. | |
| 6,314,722 | B1 * | 11/2001 | Matros et al. | 60/274 |
| 6,576,032 | B2 | 6/2003 | Maus | |
| 6,727,097 | B2 | 4/2004 | Kumar et al. | |
| 6,742,330 | B2 | 6/2004 | Genderen | |
| 6,773,479 | B2 | 8/2004 | Debenedetti et al. | |
| 6,810,660 | B2 | 11/2004 | Hepburn et al. | |
| 6,823,660 | B2 * | 11/2004 | Minami | 60/280 |
| 6,832,473 | B2 * | 12/2004 | Kupe et al. | 60/286 |
| 6,857,188 | B2 | 2/2005 | Maus | |
| 6,883,311 | B2 | 4/2005 | Liu | |
| 6,892,529 | B2 * | 5/2005 | Duvinage et al. | 60/286 |
| 6,912,847 | B2 * | 7/2005 | Deeba | 60/297 |
| 6,916,450 | B2 * | 7/2005 | Akama et al. | 422/180 |
| 7,078,004 | B2 * | 7/2006 | Voss et al. | 423/213.5 |
| 7,093,428 | B2 * | 8/2006 | LaBarge et al. | 60/286 |
| 2001/0027165 | A1 | 10/2001 | Galligan et al. | |
| 2002/0128151 | A1 | 9/2002 | Galligan et al. | |
| 2003/0108465 | A1 | 6/2003 | Voss et al. | |
| 2003/0124037 | A1 | 7/2003 | Voss et al. | |
| 2003/0165414 | A1 | 9/2003 | Galligan et al. | |
| 2004/0009106 | A1 | 1/2004 | Galligan et al. | |
| 2004/0038819 | A1 | 2/2004 | Galligan et al. | |
| 2004/0087439 | A1 | 5/2004 | Hwang et al. | |
| 2005/0031514 | A1 | 2/2005 | Patchett et al. | |
| 2005/0056006 | A1 | 3/2005 | Huang et al. | |
| 2005/0163677 | A1 | 7/2005 | Galligan et al. | |
| 2005/0164139 | A1 | 7/2005 | Valentine et al. | |

FOREIGN PATENT DOCUMENTS

| | | | |
|---|---|---|---|
| EP | 0957241 | A2 | 11/1999 |
| EP | 1752629 | A1 | 2/2007 |
| WO | WO-00/61265 | | 10/2000 |
| WO | WO-2005/119021 | A1 | 12/2005 |
| WO | PCT/US06/047710 | | 6/2007 |

* cited by examiner

DOC AND PARTICULATE CONTROL SYSTEM FOR DIESEL ENGINES

FIELD OF THE INVENTION

The present invention is directed to an exhaust treatment system and method for removing pollutants from a diesel engine exhaust gas stream. More particularly, the present invention relates to an exhaust treatment system and method for removing particulate matter and nitrogen oxides from diesel engine exhaust gas streams.

BACKGROUND OF THE INVENTION

Compression ignition diesel engines have great utility and advantage as vehicle power plants because of their inherent high thermal efficiency (i.e. good fuel economy) and high torque at low speed. Diesel engines run at a high A/F (air to fuel) ratio under very lean fuel conditions. Because of this diesel engines have very low emissions of gas phase hydrocarbons and carbon monoxide. However, diesel exhaust is characterized by relatively high emissions of nitrogen oxides (NOx) and particulates. The particulate missions, which are measured as condensed material at 52° C., are multi-phase being comprised of solid (insoluble) carbon soot particles, liquid hydrocarbons in the form of lube oil and unburned fuel, the so called soluble organic fraction (SOF), and the so called "sulfate" in the form of $SO_3+H_2O=H_2SO_4$.

From the standpoint of emissions, however, diesel engines present problems more severe than their spark-ignition counterparts. Emission problems relate to particulate matter (PM), nitrogen oxides (NOx), unburned hydrocarbons (HC) and carbon monoxide (CO). NOx is a term used to describe various chemical species of nitrogen oxides, including nitrogen monoxide (NO) and nitrogen dioxide ($NO_2$), among others. NO is of concern because it is believed to undergo a process known as photo-chemical smog formation, through a series of reactions in the presence of sunlight and hydrocarbons, and is significant contributor to acid rain. $NO_2$ on the other hand has a high potential as an oxidant and is a strong lung irritant. Particulates (PM) are also connected to respiratory problems. As engine operation modifications are made to reduce particulates and unburned hydrocarbons on diesel engines, the $NO_2$ emissions tend to increase.

The two major components of particulate matter are the volatile organic fraction (VOF) and a soot fraction (soot). The VOF condenses on the soot in layers, and is derived from the diesel fuel and oil. The VOF can exist in diesel exhaust either as a vapor or as an aerosol (fine droplets of liquid condensate) depending on the temperature of the exhaust gas. Soot is predominately composed of particles of carbon. The particulate matter from diesel exhaust is highly respirable due to its fine particle size, which poses health risks at higher exposure levels. Moreover, the VOF contains polycyclic aromatic hydrocarbons, some of which are suspected carcinogens.

Oxidation catalysts that contain platinum group metals, base metals and combinations thereof are known to facilitate the treatment of diesel engine exhaust by promoting the conversion of both HC and CO gaseous pollutants and some proportion of the particulate matter through oxidation of these pollutants to carbon dioxide and water. Such catalysts have generally been contained in units called diesel oxidation catalysts (DOCs), which are placed in the exhaust of diesel engines to treat the exhaust before it vents to the atmosphere. In addition to the conversions of gaseous HC, CO and particulate matter, oxidation catalysts that contain platinum group metals (which are typically dispersed on a refractory oxide support) promote the oxidation of nitric oxide (NO) to $NO_2$.

The soot, on the other hand, is conventionally reduced by the incorporation of a soot filter in the diesel engine exhaust system. The soot filter is composed of wire mesh, or more commonly a porous ceramic structure. As the soot is trapped in the filter, however, back pressure in the exhaust system increases. One strategy for relieving this back pressure is to combust the soot deposited on the filter, thus unclogging the filter. Some soot filters incorporate catalysts specifically for the combustion of the soot (soot combustion catalysts). The temperatures at which soot combusts with air (containing $O_2$), however, is in excess of 500° C., which may be damaging to the soot filter depending on the accumulated soot.

A filter known in the art for trapping particulate matter is a wall-flow filter. Such wall-flow filters can comprise catalysts on the filter and burn off filtered particulate matter. A common construction is a multi-channel honeycomb structure having the ends of alternate channels on the upstream and downstream sides of the honeycomb structure plugged. This results in checkerboard type pattern on either end. Channels plugged on the upstream or inlet end are opened on the downstream or outlet end. This permits the gas to enter the open upstream channels, flow through the porous walls and exit through the channels having open downstream ends. The gas to be treated passes into the catalytic structure through the open upstream end of a channel and is prevented from exiting by the plugged downstream end of the same channel. The gas pressure forces the gas through the porous structural walls into channels closed at the upstream end and opened at the downstream end. Such structures are primarily known to filter particles out of the exhaust gas stream. Often the structures have catalysts on the substrate, which enhance the oxidation of the particles. Typical patents disclosing such catalytic structures include U.S. Pat. Nos. 3,904,551; 4,329,162; 4,340,403; 4,364,760; 4,403,008; 4,519,820; 4,559,193; and 4,563,414.

Oxidation catalysts comprising a platinum group metal dispersed on a refractory metal oxide support are known for use in treating the exhaust of diesel engines in order to convert both HC and CO gaseous pollutants and particulates, i.e., soot particles, by catalyzing the oxidation of these pollutants to carbon dioxide and water.

U.S. Pat. No. 4,510,265 describes a self-cleaning diesel exhaust particulate filter, which contains a catalyst mixture of a platinum group metal and silver vanadate, the presence of which is disclosed to lower the temperature at which ignition and incineration of the particulate matter is initiated. Filters are disclosed to include thin porous walled honeycombs (monoliths) or foamed structures through which the exhaust gases pass with a minimum pressure drop. Useful filters are disclosed to be made from ceramics, generally crystalline, glass ceramics, glasses, metals, cements, resins or organic polymers, papers, textile fabrics and combinations thereof.

U.S. Pat. No. 5,100,632 also describes a catalyzed diesel exhaust particulate filter and a method of removing deposits from the exhaust gas of a diesel engine. The method involves passing the exhaust gases through a catalyzed filter having porous walls where the walls have thereon as a catalyst a mixture of a platinum group metal and an alkaline earth metal. The catalyst mixture is described as serving to lower the temperature at which ignition of collected particulate matter is initiated.

U.S. Pat. No. 4,902,487 is directed to a process wherein diesel exhaust gas is passed through a filter to remove particulate therefrom before discharge. Particulate deposited on the filter is combusted. According to the disclosure the particulate is combusted with a gas containing $NO_2$. It is disclosed that the $NO_2$ is catalytically generated in the exhaust gas before it is passed downstream to the filter on which diesel particulate is entrapped. The $NO_2$ oxidant serves to effectively combust the collected particulate at low temperature and thus reduce the back pressure normally caused by particulate disposition on the filter. It is disclosed that, there should be enough $NO_2$ in the gas fed to the filter to effectively combust the deposited carbon soots and like particulates. Catalysts known to form $NO_2$ from NO are disclose to be useful. Such catalysts are disclosed to include platinum group metals such as Pt, Pd, Ru, Rh or combinations thereof, and platinum group metal oxides. The downstream filter can be any conventional filter. In a specific embodiment, a ceramic honeycomb monolith is coated with an alumina washcoat carrying a Pt catalyst. A particulate filter is downstream of the monolith. Carbonaceous particulate is disclosed to be combusted at a temperature generally in the order of 375° C. to 500° C. EPO 835 684 A2 discloses a system wherein the upstream catalyst is followed by a downstream catalyzed flow-through monolith. Although U.S. Pat. No. 4,902,487 discloses benefits to making $NO_2$, U.S. Pat. No. 5,157,007 teaches suppressing $NO_2$ due to the fact that the toxicity of $NO_2$ exceeds that of NO.

U.S. Pat. No. 4,714,694 discloses alumina stabilized ceria catalyst compositions. There is disclosed a method of making a material which includes impregnating bulk ceria or a bulk ceria precursor with an aluminum compound and calcining the impregnated ceria to provide an aluminum stabilized ceria. The composition further comprises one or more platinum group catalytic components dispersed thereon. The use of bulk ceria as a catalyst support for platinum group metal catalysts other than rhodium, is also disclosed in U.S. Pat. No. 4,727,052 of C. Z. Wan, et al. and in U.S. Pat. No. 4,708,946 of Ohata, et al.

U.S. Pat. No. 5,597,771 discloses the use of ceria in catalyst compositions both in bulk form, as a particulate material, and in intimate contact with the various components of the catalyst composition. The intimate contact can be accomplished by combining a ceria containing component with at least some of the other components as a soluble cerium salt. Upon application of heat, such as by calcining the cerium salt becomes ceria.

U.S. Pat. Nos. 4,624,940 and 5,057,483 refer to ceria-zirconia containing particles. It is found that ceria can be dispersed homogeneously throughout the zirconia matrix up to 30 weight percent of the total weight of the ceria-zirconia composite to form a solid solution. A co-formed (e.g., co-precipitated) ceria oxide-zirconia particulate composite can enhance the ceria utility in particles containing ceria-zirconia mixture. The ceria provides the zirconia stabilization and also acts as an oxygen storage component. The '483 patent discloses that neodymium and/or yttrium can be added to the ceria-zirconia composite to modify the resultant oxide properties as desired.

U.S. Pat. No. 5,491,120 discloses oxidation catalysts containing ceria and a bulk second metal oxide which may be one or more of titania, zirconia, ceria-zirconia, silica, alumina-silica and alpha-alumina.

U.S. Pat. No. 5,627,124 discloses oxidation catalysts containing ceria and alumina. It is disclosed that each have a surface area of at least about 10 $m^2/g$. The weight ratio of ceria to alumina is disclosed to be 1.5:1 to 1:1.5. It is further disclosed to optionally include platinum. The alumina is disclosed to preferably be activated alumina. U.S. Pat. No. 5,491,120 discloses oxidation catalysts containing ceria and a bulk second metal oxide, which may be one or more of titania, zirconia, ceria-zirconia, silica, alumina-silica and alpha-alumina.

Diesel engines for small stationary gen-sets, marine applications, and ⅔ wheeled vehicles need particulate emission control. The nature of these applications is such that sophisticated traps and regeneration control strategies are not viable. This invention describes a simple, static, device that traps particulates, optionally self-regenerates and oxidizes gaseous emissions.

SUMMARY OF THE INVENTION

The present invention is directed to an emission treatment system for treating an exhaust gas emission stream from a diesel engine. The emission treatment system of the present invention comprises, in combination and in order, an upstream oxidation catalyst, e.g., a diesel oxidation catalyst (DOC), a particulate filter and optionally a downstream catalytic element or clean-up catalyst for the treatment and/or conversion of any remaining emission contaminants in the exhaust gas stream. Optionally, the particulate filter may be catalyzed with a soot burning catalyst for regeneration of its trapping function.

DETAILED DESCRIPTION OF THE INVENTION

The present invention is directed to an emission treatment system and method for treating engine exhaust gas stream emissions from diesel engines. In one embodiment, the emission treatment system of the present invention has particular use in small diesel engines. In accordance with the present invention, small diesel engines included known stationary diesel engines and diesel engines used in light commercial vehicles, which contain less than 1-liter of total engine displacement. Examples of such small diesel engines include, but are not limited to, stationary engines, marine generators, electric power generation units (commonly referred to as a gen-sets), and 2- or 3-wheeled vehicle engines. More specifically, the present invention is directed to an emission treatment system for the treatment and/or conversion of exhaust gas emission contaminants such as unburned hydrocarbons (HC), carbon monoxide (CO), particulate matter, and nitrogen oxides (NOx).

The emission treatment system of the present invention can be an integrated system comprising, in combination and in order, an upstream oxidation catalyst, e.g., a diesel oxidation catalyst (DOC), a particulate filter and optionally a downstream catalytic element or clean-up catalyst for the treatment and/or conversion of any remaining emission contaminants in the exhaust gas stream. In this embodiment, the emission treatment system is "integrated" in that the upstream oxidation catalyst, particulate filter and downstream catalytic element or clean-up catalyst are all contained within a single canister, thereby comprising a single emission treatment device. The oxidation catalyst, particulate filter and downstream catalytic element are in fluid communication with one another allowing engine exhaust gases to flow sequentially from the engine through the oxidation catalyst, through the particulate filter and finally through the downstream catalytic element and out of the emission treatment system.

In one embodiment of the present invention, the particulate filter can optionally be catalyzed with a soot burning catalyst for regeneration of the filter. In the practice of this embodiment, the upstream oxidation catalyst increases the temperature of the exhaust gas stream thereby assisting in catalyst light-off in the downstream particulate filter.

Figure 1:
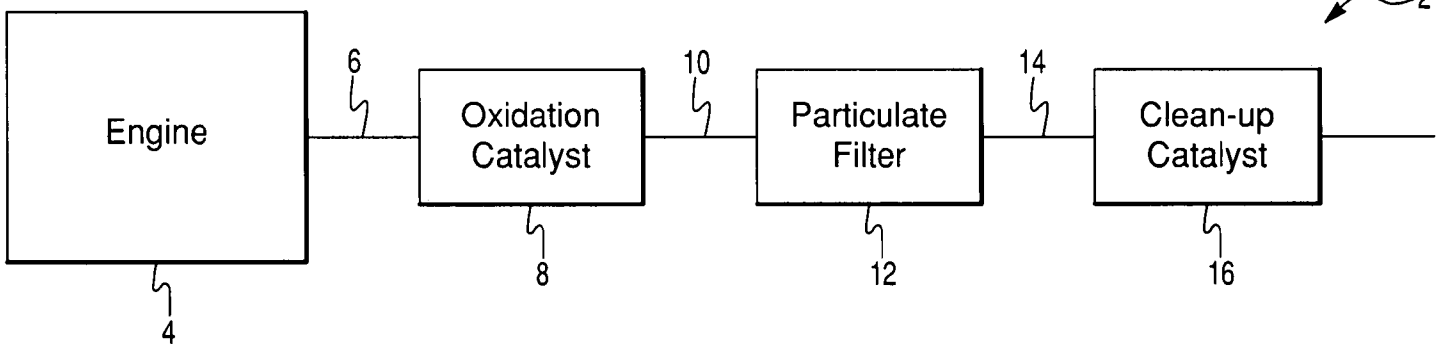
FIG. 1 is a schematic of an engine emission treatment system, in accordance with one embodiment of the present invention.

The emission treatment system of the present invention may be more readily appreciated by reference to FIG. 1, which depicts a schematic representation of an emission treatment system 2, in accordance with one embodiment of the present invention. Referring to FIG. 1, an exhaust gas stream containing gaseous pollutants (e.g., unburned hydrocarbons, carbon monoxide and NOx) and particulate matter is conveyed via line 6 from an engine 4 to an oxidation catalyst 8. In the oxidation catalyst 8, unburned gaseous and non-volatile hydrocarbons (i.e., the VOF) and carbon monoxide are largely combusted to form carbon dioxide and water. Removal of substantial proportions of the VOF using the oxidation catalyst, in particular, helps to prevent too great a deposition of particulate matter on the particulate filter 12 (i.e., clogging), which is positioned downstream in the emission treatment system. In addition, a proportion of the NO of the NOx component is oxidized to $NO_2$ in the oxidation catalyst. The exhaust stream is next conveyed via line 10 to a particulate filter 12, which traps particulate matter and/or catalyst poisons present within the exhaust gas stream. Optionally, the particulate filter can be catalyzed with a soot burning catalyst for regeneration of the particulate filter 12. After removal of particulate matter, via the particulate filter 12, the exhaust gas stream is conveyed via line 14 to a downstream catalytic element 16 for the treatment and/or conversion of any remaining emission contaminants in the exhaust gas stream. The downstream catalytic element 16 can be catalyzed, for example, with an oxidation catalyst washcoat or a three-way conversion catalyst.

Figure 2:
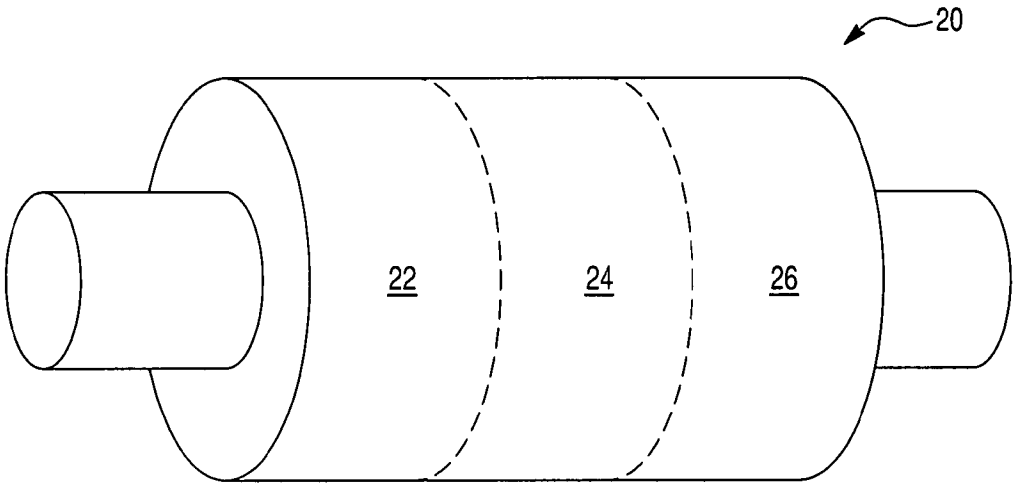
FIG. 2 is a schematic of an integrated emission treatment system, in accordance with one embodiment of the present invention.

In another embodiment, the emission treatment system of the present invention may be integrated into one canister or housing. FIG. 2 depicts a schematic representation of an integrated emission treatment system 20. The integrated emission treatment system 20 comprises an upstream oxidation catalyst section 22, a middle particulate filter section 24, and a downstream catalytic element 26. During the treatment of an exhaust gas emission stream the exhaust gas flows from an engine through the integrated emission treatment system 20 for the treatment and/or conversion of exhaust gas emission contaminants such as unburned hydrocarbons (HC), carbon monoxide (CO), particulate matter, and nitrogen oxides (NOx) and particulate matter. The exhaust gas flows sequentially through the upstream oxidation catalyst section 22, a middle particulate filter section 24, and a downstream catalytic element 26.

In general, the oxidation catalyst of the present invention can be any known oxidation catalyst (e.g., a diesel oxidation catalyst (DOC)), which provides effective combustion of unburned gaseous and non-volatile hydrocarbons (i.e., the VOF) and carbon monoxide. Preferably, the oxidation catalyst used in the present invention is a sulfur-tolerant oxidation catalyst. In addition, the oxidation catalyst may be effective to convert a substantial proportion of the NO of the NOx component to $NO_2$. As used herein, the term "substantial conversion of NO of the NOx component to $NO_2$" means at least 20%, and preferably between 30 and 60%. Catalyst compositions having these properties are known in the art, and include platinum group metal- and base metal-based compositions.

Oxidation catalysts comprising a platinum group metal dispersed on a refractory metal oxide support are known for use in treating the exhaust of diesel engines in order to convert both hydrocarbon and carbon monoxide gaseous pollutants by catalyzing the oxidation of these pollutants to carbon dioxide and water. Such catalysts have been generally contained in units called diesel oxidation catalysts, or more simply catalytic converters or catalyzers, which are placed in the exhaust flow path from a diesel power systems to treat the exhaust before it vents to the atmosphere. Typically, the diesel oxidation catalysts are formed on ceramic or metallic carriers (such as the flow-through monolith carrier, as described hereinbelow) upon which catalytic washcoat compositions are deposited. As used herein, the term "washcoat" has its usual meaning in the art of a thin, adherent coating of a catalytic or other material applied to a substrate carrier material, such as a honeycomb-type carrier member.

The oxidation catalyst washcoat of the present invention may contain base metal catalytic agents, platinum group metal catalytic agents or combinations of both that are supported on refractory metal oxides, e.g., activated alumina. Base metal catalytic agents may include rare earth metal oxides, particularly lanthanum oxide, cerium oxide and praseodymium oxide. Preferred platinum group metal catalytic agents may include platinum, palladium, rhodium and combinations thereof. Useful refractory metal oxides may include silica, alumina, gamma-alumina, titania, zirconia, silica-alumina and ceria-zirconia. Optionally, the catalytic washcoat composition also may contain other additives such as promoters and stabilizers.

For example, platinum group metal-based compositions suitable for use in forming the oxidation catalyst are also described in U.S. Pat. No. 5,100,632 (the '632 patent) hereby incorporated by reference. The '632 patent describes compositions that have a mixture of platinum, palladium, rhodium, and ruthenium and an alkaline earth metal oxide such as magnesium oxide, calcium oxide, strontium oxide, or barium oxide with an atomic ratio between the platinum group metal and the alkaline earth metal of about 1:250 to about 1:1, and preferably about 1:60 to about 1:6.

Other oxidation catalyst composition that may be used in the emission treatment system contain a platinum group component (e.g., platinum, palladium or rhodium components) dispersed on a high surface area, refractory oxide support (e.g., gamma-alumina), optionally, may be combined with a zeolite component (e.g., a beta zeolite). Platinum group metal-based compositions suitable for use in forming the oxidation catalyst are described in U.S. Pat. No. 5,100,632 (the '632 patent) hereby incorporated by reference. The '632 patent describes compositions that have a mixture of one or more of platinum, palladium, rhodium, and ruthenium and/or an alkaline earth metal oxide such as magnesium oxide, calcium oxide, strontium oxide, or barium oxide with an atomic ratio between the platinum group metal and the alkaline earth metal of about 1:250 to about 1:1, and preferably about 1:60 to about 1:6.

Catalyst compositions suitable for the oxidation catalyst may also be formed using base metals as catalytic agents. For example, U.S. Pat. No. 5,491,120 herein incorporated by reference, discloses oxidation catalyst compositions that include a catalytic material having a BET surface area of at least about 10 $m^2/g$ and consist essentially of a bulk second metal oxide, which may be one or more of titania, zirconia, ceria-zirconia, silica, alumina-silica, alumina, and alpha-alumina.

Also useful are the catalyst compositions disclosed in U.S. Pat. No. 5,462,907 (the '907 patent) herein incorporated by reference. The '907 patent teaches compositions that include a catalytic material containing ceria and alumina each having a surface area of at least about 10 $m^2/g$, for example, ceria and activated alumina in a weight ratio of from about 1.5:1 to 1:1.5. Optionally, platinum may be included in the compositions described in the '907 patent in amounts effective to promote gas phase oxidation of CO and unburned hydrocarbons but which are limited to preclude excessive oxidation of SO to $SO_2$. Alternatively, palladium in any desired amount may be included in the catalytic material.

A sulfur-tolerant catalyst may be preferred. In general, any known sulfur-tolerant oxidation catalyst, such as the oxidation catalyst disclosed in U.S. Pat. No. 5,145,825, can be used. The '825 patent discloses an oxidation catalyst which is resistant to deactivation by sulfur oxides and which is useful in the oxidation of carbon monoxide and hydrocarbons such as those present in waste and exhaust gas streams which further contain SOx. According to the '825 patent, the alumina refractory base typically used in commercially available oxidation catalysts is replaced with silica which is stabilized by the addition of titania or zirconia to yield a base which can effectively anchor the precious metal component and is resistant to SOx degradation and deactivation.

Typically, the oxidation catalyst is coated on ceramic or metallic carriers (such as a honeycomb flow-through monolith substrates described in more detail hereinbelow) upon which catalytic washcoat compositions can be deposited. As discussed above, the catalytic washcoats generally contains one or more base metal catalytic agents, platinum group metal catalytic agents or combinations of both that are supported on one or more refractory metal oxides, e.g., activated alumina. These oxidation catalysts, by virtue of the substrate on which they are coated, and/or by virtue of their intrinsic oxidation catalytic activity may provide some level of particulate removal. The removal of some of the particulate matter from the exhaust stream upstream of the particulate filter may be preferred, since the reduction in the particulate mass on the particulate filter may improve the efficiency of the particulate filter to trap particulate matter and/or catalyst poisons.

The carrier used in this invention should be relatively inert with respect to the catalytic composition dispersed thereon. The preferred carriers are comprised of ceramic-like materials such as cordierite, a-alumina, silicon nitride, zirconia, mullite, spodumene, alumina-silica-magnesia or zirconium silicate, or of refractory metals such as stainless steel. The carriers are preferably of the type sometimes referred to as honeycomb or monolithic carriers, comprising a unitary cylindrical body having a plurality of fine, substantially parallel gas flow passages extending therethrough and connecting both end-faces of the carrier to provide a "flow-through" type of carrier. Such monolithic carriers may contain up to about 700 or more flow channels ("cells") per square inch of cross section, although far fewer may be used. For example, the carrier may have from about 7 to 600, more usually from about 200 to 400, cells per square inch ("cpsi"). Flow-through carriers are preferred as substrates for the catalyst. In a preferred embodiment, the upstream oxidation catalyst of the present invention is coated on a low cell density flow-through carrier having from about 50 to about 200 cpsi. The use of a low cell density flow-through carrier prevents clogging of the flow channels by soot and other particulate matter contained in the exhaust gas stream. The cells can have cross sections that are rectangular, square, circular, oval, triangular, hexagonal, or are of other polygonal shapes.

The exhaust treatment system of the present invention also contains a particulate filter or soot filter to trap the particulate matter and/or catalyst poisons thereby preventing the soot and/or poisons from venting to the downstream catalytic element or clean-up catalyst and/or directly to the atmosphere. In general, any known particulate filter in the art can be used, including, e.g., a wire mesh or screen structured filter, a honeycomb wall-flow filter, wound or packed fiber filter, open-cell foam, sintered metal powder filters; sintered metal fiber filters; perforated metal foil filters; or ceramic fiber composite filters, etc.

Particulate or soot filters are typically formed from refractory materials, such as ceramics or metals. In the practice of the present invention, the particulate filter can be placed in a canister (also referred to as a housing), which directs the fluid stream to be treated through the canister inlet to the inlet side of the filter, through the filter and subsequently out of the filter canister. Particulate filters useful for the purposes of this invention include structures through which the exhaust stream passes without causing too great an increase of back pressure or pressure drop across the article. The ceramic substrate may be made of any suitable refractory material, e.g., cordierite, cordierite-alumina, silicon nitride, zircon mullite, spodumene, alumina-silica magnesia, zircon silicate, sillimanite, a magnesium silicate, zircon, petalite, alumina, alpha-alumina, an aluminosilicate and the like.

While it will be apparent to those of ordinary skill in the art that $NO_2$ can combust the particulate matter without the aid of catalyst, the wall-flow filters can contain catalytic agents on various catalyst supports on or in the filter. In one embodiment, the particulate filter may be coated with one or more catalytic agents, which can promote the combustion of the particulate matter at lower temperatures, e.g., at 150-300° C. The catalytic agents can be, for example, deposited on the particulate filter using catalytic washcoats. Catalytic agents effective in combusting the particulate matter with nitrogen dioxide include platinum on a catalyst support (e.g., activated alumina, zirconia). Other catalytic agents effective for promoting the combustion of soot include $V_2O_5$, $WO_3$, $Ag_2O$, $Re_2O_7$, $CeO_2$, $FeO_2$, $MnO_2$, NiO, CuO and combinations thereof. These catalytic agents can be used alone or on supports such as alumina or zirconia.

In some embodiments it is preferable to deposit a lean NOx catalyst on the soot filter to promote the combustion of unburned hydrocarbons with $NO_2$ or $O_2$. At higher temperatures, preferably at temperatures above at least 150° C., the $NO_2$ serves as an effective oxidant for the unburned hydrocarbon. Lean NOx catalysts are known in the art, and include zeolite materials doped with platinum or rhodium. A preferred lean NOx catalyst is platinum doped ZSM-5.

In another embodiment of the present invention, the particulate filter is a partial particulate filter, e.g., a foam substrate particulate filter. In as much as small diesel engine exhaust streams typically have lower levels of particulates, the particulate reduction requirement may not be as high as that of an automobile diesel engine. The partial particulate filter is a partial particulate filter in the sense that some but not all of the particulate matter in the exhaust gas stream is captured. In one embodiment, typically less than 90% of the particulate matter in an exhaust gas stream is captured. However, partial particulate filters which trap less than 85%, and less than 60%, of the particulate matter in an exhaust gas stream, are also exemplified. Examples of such partial particulate filters include, but are not limited to, screen filters, mesh filters, foam filters, foil filters, corrugated metal filters, non-permeable filters, and other non-wall-flow filters (see, e.g., U.S. Pat. Nos. 4,597,262; 6,576,032; 6,773,479; and 6,857,188; which are incorporated herein by reference). The use of a foam substrate particulate filter may be particularly useful in small diesel engines, such as, for example, stationary engines, marine generators, electric power generation units (commonly referred to as a gen-sets), or 2- or 3-wheeled vehicle engines, where the use of a high cost, highly efficient particulate filter, such as a wall-flow particulate filter, may not be required. Due to the internal structure and flow through nature of a foam particulate filter, a foam substrate, e.g., a metallic foam substrate, allows for sufficient trapping of particulate matter and/or catalyst poisons without creating significant back pressure concerns and potentially without requiring regeneration of the particulate filter via burning off of the trapped soot.

Figure 3A:
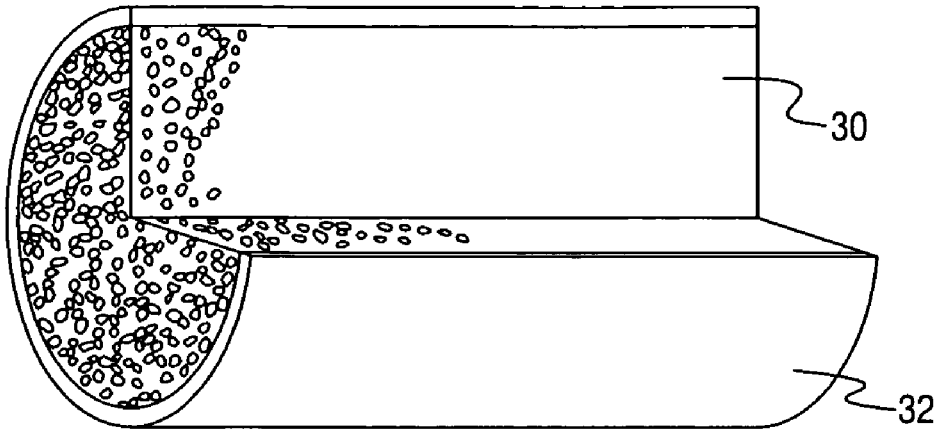
FIG. 3*a* is a pictorial sectional view illustrating the general configuration of a metallic foam trap in accordance with one embodiment of the present invention.
Figure 3B:
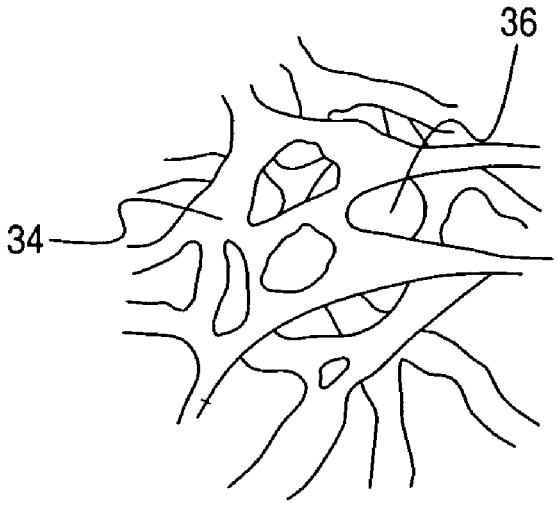
FIG. 3*b* is an enlarged schematic fragmental view of the three-dimensional network of the metallic foam trap.

The metallic foam substrate of the present invention forms an open or reticulated substrate structure comprising metallic cells or pores consisting of struts for the cellular walls, see FIGS. 3*a* and 3*b*. The metallic foam substrate can be further described as a porous matrix having a plurality of irregularly shaped passages wherein exhaust gases undergo multiple random twists and turns in traveling from the upstream side to the downstream side of the trap, see FIG. 3*b*. This turbulent or tortuous flow path is defined by numerous apertures, pores, channels or similar structural features that cause liquid and/or gas to flow therethrough in turbulent or substantially non-laminar fashion and give the substrate a high surface area per overall volume of the flow path of the fluid through the substrate, e.g., features that create a high mass transfer zone for the fluid therein. In contrast, a dense substrate, such as a plate, tube, foil and the like, has a relatively small surface area per overall volume of the flow path through the substrate regardless of whether it is perforated or not, and do not substantially disrupt laminar flow therethrough. The open or reticulated substrate structure of the metallic foam, importantly not only provides a high mass transfer zone, but such open structure reduces the backpressure.

The metallic foam trap of the present invention may be more readily appreciated by reference again to FIG. 3*a*, which depicts a schematic perspective view of a metallic foam trap, and FIG. 3*b*, which depicts an enlarged schematic fragmental view of the three-dimensional network of the metallic foam trap, both non-limiting embodiments of the invention. Referring to FIGS. 3*a* and 3*b*, a metallic foam trap 30 is housed within a housing unit 32. The figure shows an open network of metallic struts 34 and pores 36, which makes up a torturous pathway for an engine exhaust gas stream. The metallic foam preferentially collects particulate matter primarily in the gaseous phase and serves as a physical barrier to prevent poisonous species from contacting the downstream monolithic precious metal catalyst.

Since these metallic foam structures have higher surface areas than dense substrates and since they permit fluid flow therethrough, they are well-suited for use in preparing filter members for the trapping of liquid- or gas-borne particulate materials and/or catalyst poisons. Furthermore, the high surface area provides for improved mass transfer of active species thereby improving the efficiency of the metallic foam for trapping particulate matter and/or catalyst poisons.

Methods for making foamed metal are known in the art, see e.g., U.S. Pat. No. 3,111,396, which is incorporated herein by reference, and the use of foamed metal as a carrier for a catalytic material has been suggested in the art, see e.g., SAE Technical Paper 971032, entitled "A New Catalyst Support Structure For Automotive Catalytic Converters" by Arun D. Jatkar, which was presented at the International Congress and Exposition, Detroit, Mich., Feb. 24-27, 1997, and Pestryakov et al., Journal of Advanced Materials, 1(5), 471-476 (1994). Metallic foams can be characterized in various ways, some of which relate to the properties of the initial organic matrix about which the metal is disposed. Some characteristics of foamed metal substrates recognized in the art include cell size, density, free volume, and specific surface area. For example, the surface area may be 1500 times that of a solid substrate having the same dimensions as the foamed substrate. As mentioned by Pestryakov et al, foamed metal substrates useful as carriers for catalyst members may have mean cell diameters in the range of 0.5 to 5 mm, and they may have a free volume of from about 80 to 98%, e.g., 3 to 15 percent of the volume occupied by the foamed substrate may constitute metal. The porosity of the substrate may range from 3 to 80 pores per inch (ppi), e.g., from 3 to 30 ppi, or from 3 to 10 ppi, or from 3 to 5 ppi. In an illustrative range of 10 to 80 ppi, other characteristics such as cells per square inch may range from 100 to 6400 and the approximate web diameter may vary from 0.01 inch to 0.004 inch. Such foams may have open-cell reticulated structures, based on a reticulated/interconnected web precursor. They typically have surface areas that increase with porosity in the range of from about 700 square meters per cubic foot of foam ($m^2/ft^3$) at about 10 ppi to 4000 $m^2/ft^3$ at about 60 ppi, etc. Other suitable metallic foamed substrates have surface areas ranging from about 200 square feet per cubic foot of foamed metal ($ft^2/ft^3$) at about 10 ppi to about 1900 $ft^2/ft^3$ at about 80 ppi. One such substrate has a specific weight of 500 g/m at a thickness of about 1.6±0.2 millimeters with a porosity of 110 ppi. They may have volume densities in the range of 0.1 to 0.3 grams per cubic centimeter (g/cc).

Metallic foamed substrates can be formed from a variety of metals, including iron, titanium, tantalum, tungsten noble metals, common sinterable metals such as copper, nickel, bronze, etc., aluminum, zirconium, etc., and combinations and alloys thereof such as steel, stainless steel, Hastalloy, Ni/Cr, Inconel (nickel/chromium/iron), Monel (nickel/copper), and Fecralloy (iron/ chromium/aluminum/yttrium). In one embodiment, the metallic foam substrate is selected from the group consisting of stainless steel, titanium, Fecralloy, aluminum zirconate, aluminum titanate, aluminum phosphate, cordierite, mullite and corundum. In another embodiment, Fecralloy (FeCrAlY) is exemplified. A suitable metallic foam substrate for use with the present invention has a volume occupied by the foamed substrate of about 3 percent to about 10 percent. From about 6 to about 8 percent is also exemplified.

The metallic foam trap is preferably coated with a high-surface area component, said component comprising a pretreatment metallic thermal arc sprayed layer and optionally a washcoat layer, such as aluminum oxide, cerium oxide, and zirconium oxide. The metallic thermal arc sprayed layer coating can be useful to facilitate the adhesion of the washcoat layer. The metallic thermal arc sprayed layer of the present invention can be applied with a thermal spraying processes in general, including plasma spraying, single wire plasma spraying, high velocity oxy-fuel spraying, combustion wire and/or powder spraying, electric arc spraying, etc.

In one aspect of the present invention, electric arc spraying, e.g., twin wire arc spraying, of a metal (which term, as used herein and in the claims, includes mixtures of metals, including without limitation, metal alloys, pseudoalloys, and other intermetallic combinations) onto metallic foam substrate yields a structure having unexpectedly superior utility as a substrate for a washcoat layer, e.g., a refractory metal oxide. Twin wire arc spraying (encompassed herein by the term "wire arc spraying" and by the broader term "electric arc spraying") is a known process, see e.g., U.S. Pat. No. 4,027,367, which is incorporated herein by reference. Briefly described, in the twin wire arc spray process, two feedstock wires act as two consumable electrodes. These wires are insulated from each other as they are fed to the spray nozzle of a spray gun in a fashion similar to wire flame guns. The wires meet in the center of a gas stream generated in the nozzle. An electric arc is initiated between the wires, and the current flowing through the wires causes their tips to melt. A compressed atomizing gas, usually air, is directed through the nozzle and across the arc zone, shearing off the molten droplets to form a spray that is propelled onto the substrate. Only metal wire feedstock can be used in an arc spray system because the feedstock must be conductive. The high particle temperatures created by the spray gun produce minute weld zones at the impact point on a metallic substrate. As a result, such electric arc spray coatings (sometimes referred to herein as "anchor layers") have good cohesive strength and a very good adhesive bond to the substrate.

Thermal arc sprayed layers of a variety of compositions can be deposited on a metallic foam substrate in accordance with the present invention by utilizing, without limitation, feedstocks of the following metals and metal mixtures: Ni, Ni/Al, Ni/Cr, Ni/Cr/Al/Y, Co/Cr, Co/Cr/Al/Y, Co/Ni/Cr/AV/Y, Fe/Al, Fe/Cr, Fe/Cr/Al, Fe/Cr/Al/Y, Fe/Ni/Al, Fe/Ni/Cr, 300 and 400 series stainless steels, and, optionally, mixtures of one or more thereof. In one embodiment, the metallic thermal arc sprayed layer may comprise nickel and aluminum. The aluminum may comprise from about 3 to 10 percent, optionally from about 6 to 8 percent, of the combined weight of nickel and aluminum in the metallic thermal arc sprayed layer.

In one embodiment of the present invention, a high surface area temperature resistant refractory layer can be coated onto a metallic thermal arc sprayed layer. Useful high surface area refractory layers include one or more refractory oxides. These oxides include, for example, silica and metal oxides such as alumina, including mixed oxide forms such as silica-alumina, aluminosilicates which may be amorphous or crystalline, alumina-zirconia, alumina-chromia, alumina-ceria and the like. In another embodiment, the support may be substantially comprised of alumina which preferably includes the members of the gamma or activated alumina family, such as gamma and eta aluminas, and, if present, a minor amount of other refractory oxide, e.g., about up to 20 weight percent. Desirably, the active alumina has a specific surface area of 30 to 300 $m^2/g$.

Other suitable materials for the refractory metal oxide layer include alumina, silica, titania, titania-alumina, silica-alumina, alumino-silicates, zirconia, titania-zirconia, aluminum-zirconium oxide, aluminum-chromium oxide, baria-alumina, etc. Such materials are preferably used in their high surface area forms. For example, gamma-alumina is preferred over alpha-alumina. Alternatively, the refractory layer may be made of any suitable refractory materials such as cordierite, cordierite-alpha-alumina, silicon nitride, zirconium mullite, spodumene, alumina-silica magnesia, zirconium silicate, sillimanite, magnesium silicates, zirconium oxide, petallite, alpha-alumina and alumino-silicates. In one embodiment of the present invention the refractory layer may be selected from the group consisting of refractory oxides such as alumina, titania, zirconia, zirconia-alumina, zirconia-titania, titania-alumina, lanthana-alumina, baria-zirconia-alumina, niobia-alumina, and silica-leached cordierite.

The refractory metal oxide layer is preferably porous in nature and has a high surface area such as alumina, preferably gamma-alumina. The choice of the support material is not critical to the invention. Desirably, the refractory metal oxide support will have a surface area of between about 5 and about 350 $m^2/g$. Typically, the support will be present in the amount of about 1.5 to about 5.0 $g/in^3$, preferably 2 to 4 $g/in^3$.

Optionally, downstream of the particulate filter the emission treatment system of the present invention can include an additional catalytic element or clean-up catalyst for the treatment and/or conversion of any remaining emission contaminants in the exhaust gas stream. In general, any known catalyst for treating and/or converting emission contaminants can be used as the downstream catalytic element or clean-up catalyst. For example, the clean-up catalyst component may be, for example, an oxidation catalyst or a three-way conversion (TWC) catalyst. Typically, the downstream catalytic element or clean-up catalyst is coated as a washcoat on a substrate carrier, e.g., a flow-through monolith.

Oxidation catalysts useful as the downstream catalytic element or clean-up catalyst are described hereinabove. Briefly, the oxidation catalyst washcoat may contain base metal catalytic agents, platinum group metal catalytic agents or combinations of both that are supported on refractory metal oxides, e.g., activated alumina. Base metal catalytic agents may include rare earth metal oxides, particularly lanthanum oxide, cerium oxide and praseodymium oxide. Preferred platinum group metal catalytic agents may include platinum, palladium, rhodium and combinations thereof. Useful refractory metal oxides may include silica, alumina, gamma-alumina, titania, zirconia, ailica-alumina and ceria-zirconia. Optionally, the catalytic washcoat composition also may contain other additives such as promoters and stabilizers.

In another embodiment, the downstream catalytic element or clean-up catalyst of the present invention may be a three-way conversion (TWC) catalyst. TWC catalysts are known in the art and can simultaneously catalyzes the oxidation of hydrocarbons and carbon monoxide and the reduction of nitrogen oxides and sulfur oxides in a gas exhaust stream. Known TWC catalysts which exhibit good activity and long life comprise one or more platinum group metals (e.g., platinum, paladium, rhodium, rhenium and iridium) disposed on a high surface area, refractory metal oxide support, e.g., a high surface area alumina coating. The support is carried on a suitable carrier or substrate such as a monolithic carrier comprising a refractory ceramic or metal honeycomb structure, or refractory particles such as spheres or short, extruded segments of a suitable refractory material. The refractory metal oxide supports may be stabilized against thermal degradation by materials such as zirconia, titania, alkaline earth metal oxides such as baria, calcia or strontia or, most usually, rare earth metal oxides, for example, ceria, lanthana and mixtures of two or more rare earth metal oxides. For example, see C. D. Keith et al U.S. Pat. No. 4,171,288.

TWC catalysts are currently formulated with complex washcoat compositions containing stabilized $Al_2O_3$, an oxygen storage component, primarily ceria, and precious metal catalytic components. Such catalysts are designed to be effective over a specific operating range of both lean of, and rich of, stoichiometric conditions. The term "oxygen storage component" is used to designate a material which is believed to be capable of being oxidized during oxygen-rich (lean) cycles of the gas being treated, and releasing oxygen during oxygen-poor (rich) cycles. Oxygen storage components as well as alumina support materials are susceptible to thermal degradation at the high operating temperatures engendered by smaller automotive engines and high speed highway driving, and such thermal degradation adversely affects the stability of the catalyst and effectiveness of the precious metals used therein. In addition, attempts to improve fuel economy by using air-to-fuel ("A/F") ratios higher than stoichiometric, and/or fuel shut-off features, generate a lean (oxygen-rich) exhaust. High exhaust gas temperatures and lean gas conditions accelerate the deterioration of platinum and rhodium catalysts, inasmuch as platinum is more readily sintered, and rhodium more strongly interacts with support materials such as alumina, at such conditions.

Other TWC catalyst known in the art can be used in the practice of the present invention. For example, U.S. Pat. Nos. 4,476,246, 4,591,578 and 4,591,580, incorporated herein by reference, disclose three-way catalyst compositions comprising alumina, ceria, an alkali metal oxide promoter, and Noble metals. U.S. Pat. Nos. 3,993,572 and 4,157,316, incorporated herein by reference, describe attempts to improve the catalyst efficiency of Pt/Rh based TWC systems by incorporating a variety of metal oxides, e.g., rare earth metal oxides such as ceria and base metal oxides such as nickel oxides. U.S. Pat. No. 4,591,578 discloses a catalyst comprising an alumina support with catalytic components consisting essentially of a lanthana component, ceria, an alkali metal oxide, and a platinum group metal. U.S. Pat. No. 4,591,580 discloses an alumina supported platinum group metal catalyst modified to include support stabilization by lanthana or lanthana rich rare earth oxides, double promotion by ceria and alkali metal oxides and optionally nickel oxide.

Another useful TWC catalyst is disclosed in U.S. Pat. No. 4,294,726, incorporated herein by reference, which discloses a TWC catalyst composition containing platinum and rhodium obtained by impregnating a gamma alumina carrier material with an aqueous solution of cerium, zirconium and iron salts or mixing the alumina with oxides of, respectively, cerium, zirconium and iron, and then calcining the material at 500 to 700° C. in air after which the material is impregnated with an aqueous solution of a salt of platinum and a salt of rhodium dried and subsequently treated in a hydrogen-containing gas at a temperature of 250-650° C. The alumina may be thermally stabilized with calcium, strontium, magnesium or barium compounds. The ceria-zirconia-iron oxide treatment is followed by impregnating the treated carrier material with aqueous salts of platinum and rhodium and then calcining the impregnated material.

In another example, U.S. Pat. No. 4,965,243, incorporated herein by reference, discloses a method to improve thermal stability of a TWC catalyst containing precious metals by incorporating a barium compound and a zirconium compound together with ceria and alumina. This is disclosed to form a catalytic moiety to enhance stability of the alumina washcoat upon exposure to high temperature.

Typically, the downstream catalytic element or clean-up catalyst is coated on ceramic or metallic carriers (such as a honeycomb flow-through monolith substrates described in more detail hereinbelow) upon which catalytic washcoat compositions can be deposited. As discussed above, the carrier used in this aspect of the invention should be relatively inert with respect to the catalytic composition dispersed thereon. The preferred carriers are comprised of ceramic-like materials such as cordierite, a-alumina, silicon nitride, zirconia, mullite, spodumene, alumina-silica-magnesia or zirconium silicate, or of refractory metals such as stainless steel. The carriers are preferably of the type sometimes referred to as honeycomb or monolithic carriers, comprising a unitary cylindrical body having a plurality of fine, substantially parallel gas flow passages extending therethrough and connecting both end-faces of the carrier to provide a "flow-through" type of carrier. Such monolithic carriers may contain up to about 700 or more flow channels ("cells") per square inch of cross section, although far fewer may be used. For example, the carrier may have from about 7 to 600, more usually from about 200 to 400, cells per square inch ("cpsi"). Flow-through carriers are preferred as substrates for the second catalyst. In a preferred embodiment, the downstream catalytic element or clean-up catalyst of the present invention is coated on a flow-through carrier having a cell density from about 100 to about 400 cpsi. The use of a higher cell density flow-through carrier is possible because the catalytic element or clean-up catalyst is downstream of the particulate filter or soot filter, and thus, clogging of the flow-through channels by particulate matter is not a major concern. The cells can have cross sections that are rectangular, square, circular, oval, triangular, hexagonal, or are of other polygonal shapes.

What is claimed is:

1. An exhaust treatment system for treating an exhaust gas stream produced by a small diesel engine comprising:

a. an upstream oxidation catalyst deposited on a ceramic or metallic honeycomb flow-through substrate;

b. a partial particulate filter located downstream of said oxidation catalyst, wherein said partial particulate filter captures less than 90% of the particulate matter in said exhaust gas stream; and c. wherein said small engine has a total engine displacement of less than 1-liter.

2. The exhaust treatment system of claim 1, wherein said partial particulate filter is a screen, mesh or foam particulate filter.

3. The exhaust treatment system of claim 1, wherein said system further comprises a catalytic element located downstream of said partial particulate filter, and wherein said catalytic element comprises a catalyst for the further treatment of remaining gaseous emission contaminants in the exhaust gas stream and wherein said catalyst is deposited on a ceramic or metallic honeycomb flow-through substrate.

4. The exhaust treatment system of claim 3, wherein said catalyst is an oxidation catalyst or a three-way conversion catalyst.

5. The exhaust treatment system of claim 2, wherein said partial particulate filter is a metallic foam particulate filter and wherein said metallic foam is selected from the group consisting of stainless steel, titanium, Fecralloy, aluminum zirconate, aluminum titanate, aluminum phosphate, cordierite, mullite and corundum.

6. The exhaust treatment system of claim 2, wherein said metallic foam is coated with a metallic thermal arc sprayed layer and a refractory oxide layer selected from the group consisting of refractory oxides such as alumina, gamma-alumina, titania, zirconia, zirconia-alumina, zirconia-titania, titania-alumina, lanthana-alumina, baria-zirconia-alumina, niobia-alumina, and silica-leached cordierite.

7. The exhaust treatment system of claim 3, wherein said partial particulate filter is coated with a soot burning catalyst for regeneration of the trapping function of said particulate filter.

8. A method of treating exhaust gas stream emissions from a small diesel engine, said exhaust gas stream comprising nitrogen oxides (NOx) and particulate matter, said method comprising the steps of:

a. providing an emission treatment system comprising an upstream oxidation catalyst, and a middle partial particulate filter section; and b. flowing said exhaust gas from said small diesel engine sequentially through said upstream oxidation catalyst, and said particulate filter, wherein said small diesel engine has a total engine displacement of less than 1-liter.

9. The method of claim 8, wherein said partial particulate filter is a metallic foam particulate filter.

10. The exhaust treatment system of claim 3, wherein said exhaust treatment system is an integrated system comprising said upstream oxidation catalyst, said partial particulate filter and said downstream catalytic element all contained within a single canister.

11. The method of claim 8, wherein said emission treatment system further comprises a catalytic element located downstream of said partial particulate filter, wherein said catalytic element comprises a catalyst for the further treatment of remaining gaseous emission contaminants in the exhaust gas stream and wherein and flowing said exhaust gas through said downstream catalytic element.

12. The method of claim 11, wherein said emission treatment system is an integrated system comprising said upstream oxidation catalyst, said middle partial particulate filter and said downstream oxidation catalytic element all contained within a single canister.

* * * * *